US005561514A

United States Patent [19]

Sano et al.

[11] Patent Number: 5,561,514

[45] Date of Patent: Oct. 1, 1996

[54] IMAGE FORMING APPARATUS AND SHEET ARRANGING METHOD FOR THE APPARATUS

[75] Inventors: Yoshihiko Sano; Yasuyuki Tsuji; Takeshi Terakado; Kazutoshi Obara; Masaru Kawamoto, all of Ibaraki, Japan

[73] Assignee: Hitachi Koki Co., Ltd., Tokyo, Japan

[21] Appl. No.: 390,030

[22] Filed: Feb. 17, 1995

[30] Foreign Application Priority Data

Feb. 25, 1994 [JP] Japan ..... 6-028079

[51] Int. Cl.[6] ..... G03G 21/00

[52] U.S. Cl. ..... 355/310; 355/309; 355/321

[58] Field of Search ..... 355/308, 309, 355/310, 321, 322

[56] References Cited

U.S. PATENT DOCUMENTS 4,248,523 2/1981 Doi et al. ..... 355/310
4,975,781 12/1990 Hirose ..... 355/310 X
5,229,827 7/1993 Sato et al. ..... 355/321
5,257,567 11/1993 Walker et al. ..... 355/310 X
5,331,387 7/1994 Okada et al. ..... 355/309 X

*Primary Examiner*—Sandra L. Brase
*Attorney, Agent, or Firm*—Sughrue, Mion, Zinn, Macpeak & Seas

[57] ABSTRACT

An image forming apparatus for forming images of plurality of pages on one cut sheet, includes: a sheet cutting mechanism for cutting a cut sheet on which images of a plurality of pages have been formed into smaller sheets the number of which corresponds to the number of the pages; a sheet arranging mechanism for arranging the smaller sheets thus provided; and a sheet stacking mechanism for stacking the smaller sheets thus arranged. Hence, it is unnecessary for the apparatus to have a sheet post-processing apparatus.

9 Claims, 3 Drawing Sheets

IMAGE FORMING APPARATUS AND SHEET ARRANGING METHOD FOR THE APPARATUS

BACKGROUND OF THE INVENTION

1) Field of the Invention

This invention relates to an image forming apparatus, and a sheet arranging method for the apparatus, and more particularly to an image forming apparatus which forms images of two pages on a single cut sheet.

2) Description of the Related Art

An image forming apparatus is available which is able to form images of a plurality of pages on one cut sheet. In the image forming apparatus, the cut sheet, after being printed, is handled as follows: The operator takes the cut sheet out of the apparatus, and loads it in a sheet post-processing apparatus positioned far from the image forming apparatus, where it is subjected to a sheet cutting operation; that is, it is cut into smaller sheets the number of which corresponds to the pages bearing the images, and to a sheet arranging operation; that is, those smaller sheets are arranged in order. Alternatively, the cut sheet taken out of the image forming apparatus is delivered to a sheet post-processing apparatus set adjacent to the image forming apparatus, where, similarly as in the above-described case, it is cut into smaller sheets, and the smaller sheets are arranged in order.

In the former system, the cut sheet taken out of the image forming apparatus must be loaded in the sheet post-processing apparatus located far from the image forming apparatus. This sheet loading operation is rather troublesome.

This difficulty may be eliminated by modifying the latter system as follows: The image forming apparatus and the sheet arranging apparatus are electrically or mechanically coupled to each other so that the cut sheet is automatically transferred from the image forming apparatus to the sheet arranging apparatus. In the system thus modified, the sheet can be handled efficiently. If the sheets are jammed in the sheet post-processing apparatus, the following process can be immediately suspended by applying a sheet jamming signal to the image forming apparatus. That is, it is possible to allow the image forming apparatus and the sheet post-processing apparatus to cooperate with each other to some extent.

However, the system is disadvantageous, for instance, in the following points:

After removal of the jammed sheets, it cannot be determined from where the printing operation should be started. In general, even standard sheets have a dimensional tolerance of about 2 mm, and it is impossible to accurately cut a standard sheet into smaller sheets with the dimensional tolerance taken into account. In addition, operating data are limited which can be transmitted between the image forming apparatus and the sheet post-processing apparatus. Moreover, equipment required for the image forming operation and the sheet cutting operation is physically very large in scale.

SUMMARY OF THE INVENTION

In view of the foregoing, an object of the invention is to provide an image forming apparatus having a sheet post-processing function which is effectively performed in association with image forming means to achieve delicate control operations of the apparatus, and a sheet arranging method for the apparatus.

The above object of the invention has been achieved by provision of an image forming apparatus having means for forming images of plurality of pages on a cut sheet, which comprises:

sheet cutting means for cutting a cut sheet on which images of plurality of pages have been formed into smaller sheets the number of which corresponds to the number of the pages;

sheet arranging means for arranging the smaller sheets thus provided; and sheet stacking means for stacking the smaller sheets thus arranged.

The apparatus is operated according to a sheet arranging method which comprises the steps of:

forming images of a plurality of pages on a cut sheet;

cutting the cut sheet into smaller sheets the number of which corresponds to the number of the pages;

arranging the smaller sheets thus provided in order; and stacking the smaller sheets thus arranged.

In the apparatus including the sheet cutting means and the sheet arranging means, the image forming operation and the sheet cutting operation are carried out during the conveyance of a cut sheet from the hopper to the stacker. Hence, it is unnecessary for the apparatus to have the sheet post-processing apparatus.

The nature, utility and principle of the invention will be more clearly understood from the following detailed description and the appended claim when read in conjunction with the accompanying drawings.

DETAILED DESCRIPTION OF THE PREFERRED EMBODIMENTS

An image forming apparatus, which constitutes one preferred embodiment of the invention, will be described with reference to the accompanying drawings.

Figure 1:
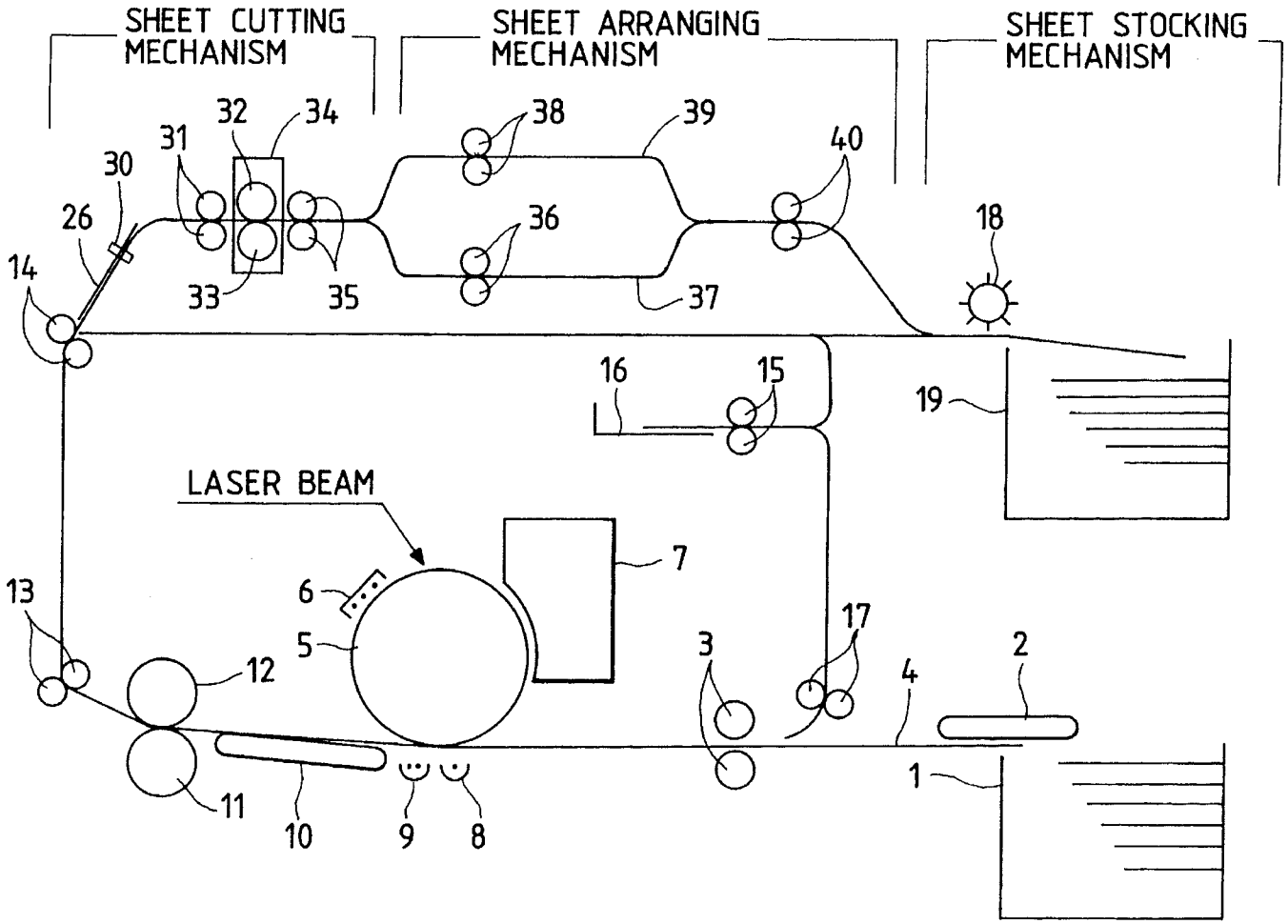
FIG. 1 is an explanatory diagram showing the arrangement of an image forming apparatus according to a preferred embodiment of the invention.

The image forming apparatus is arranged as shown in FIG. 1. In the apparatus, a laser beam is used to form a latent image on a photosensitive drum 5 which has been uniformly charged by a charger 6. A developing unit 7 operates to develop the latent image into a visible image by using toner. On the other hand, a pick belt 2 picks a sheet 4 out of a hopper 1. The sheet 4 thus picked is delivered to a transferring section by conveying rolls 3. In the transferring section, the toner image on the photosensitive drum 5 is transferred onto the sheet 4 by a transferring unit 8. The sheet 4 bearing the toner image is separated from the photosensitive drum 5 by a separating unit 9, and is then delivered to a fixing section by a conveying belt 10.

In the fixing section, the sheet 4 bearing the toner image is pressured and heated by a heat roll 11 and a back-up roll 12, so that the toner image is fixed onto the sheet 4. In the case of a one-side printing operation, the sheet 4 thus processed is conveyed by conveying rollers 13 and 14, so that it is placed in a stacker 19 by a paddle 18. In the case of a both-side printing operation, the sheet 4 is delivered to a switch-back unit 16 by the conveying rollers 13 and 14, where it is turned over by means of conveying rollers 15 and is then delivered to the photosensitive drum again by conveying rollers 17, where a latent image is formed on the other side of the sheet 4. The latent image is processed in the same manner, and the sheet 4 is placed in the stacker 19.

It is assumed that images of two pages (a plurality of pages) have been formed on one sheet 4 by the above-described one-side printing operation or both-side printing operation. The sheet 4 is divided into two smaller sheets by a sheet cutting mechanism. The two smaller sheets are delivered to a sheet arranging mechanism, where they are arranged according to their print data. The smaller sheets thus arranged are stacked in the stacker 19.

In the sheet cutting mechanism, in order to accurately cut the sheet 4 into two small sheets, a sheet cutting position is determined before the sheet cutting operation, and the cutting blade is positioned with respect to the sheet according to the sheet cutting position thus determined. The sheet is cut with the cutting blade thus positioned. For this purpose, the sheet cutting mechanism comprises: a sensor 30 for detecting the amount of shift of a sheet in the direction of width of the sheet; a circular cutter unit 34 including an upper blade 32 and a lower blade 33 for cutting a sheet 4; and conveying rolls 31 and 35 adapted to fix and convey a sheet 4.

Figure 2:
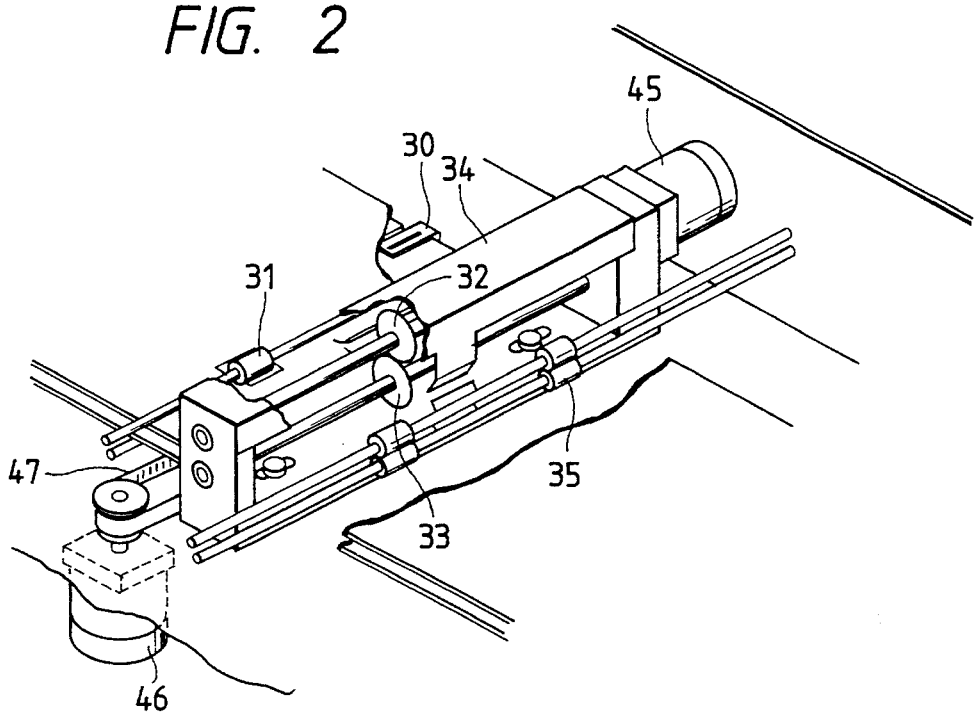
FIG. 2 is a perspective view showing a sheet cutting mechanism in the apparatus of the invention.

The sheet cutting mechanism is shown in FIG. 2 in detail. The upper and lower blades 32 and 33 of the circular cutter unit 34 are turned in opposite directions at the same speed by a circular cutter drive motor 45 while being in light contact with each other. In general, the speed of rotation of the circular cutter is set higher than the speed of conveyance of the sheet. The mechanism has a unit moving motor 46 to move the circular cutter unit 34 in the direction of width of the sheet with the aid of an endless belt 47 coupled thereto.

The sensor 30 is made up of a CCD (charge-coupled device) or the like to detect the amount of shift of a sheet in the direction of width of the sheet as analog data. The output signal of the sensor 30 is applied to a microcomputer (not shown), so that, when the sheet is shifted, the unit moving motor 46 is driven to move the circular cutter unit 34 in the direction of width of the sheet thereby to set the unit 34 at the middle of the width of the sheet. The position of the circular cutter unit 34 is detected by a sensor (not shown), so that the unit moving motor 46 is feedback-controlled. In the case where it is required to perform a printing operation for cut sheets different in size, for each of the sheets the circular cutter unit 34 is moved in the direction of width of the sheet according to the size of the sheet so that it is positioned at the middle of the width of the sheet.

Now, the sheet arranging mechanism will be described with reference to FIGS. 1, 3 and 4.

Figure 3:
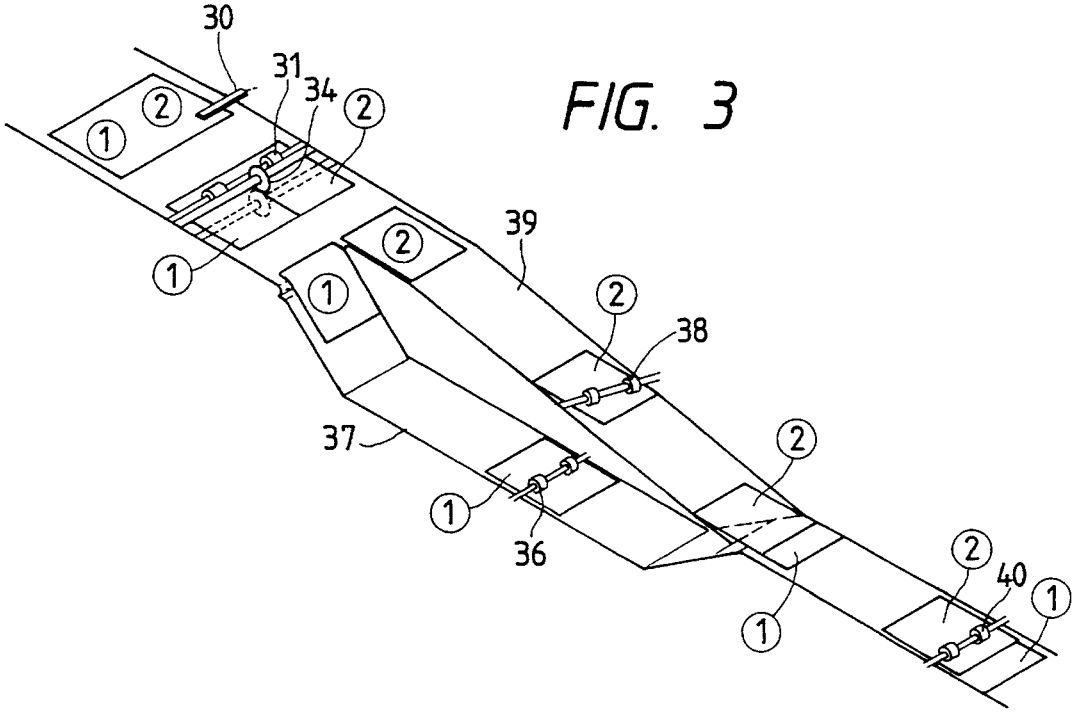
FIG. 3 is an explanatory diagram showing a sheet arranging mechanism in the apparatus of the invention.

As shown in FIG. 3, print data (1) and (2) are formed on the two smaller sheets in the stated order on which images of two pages have been formed. The smaller sheet having the data (1) is conveyed on a conveying path 37 by conveying rollers 36; while the smaller sheet having the data (2) is conveyed on a sheet-deflecting conveying path 39 by sheet-deflecting conveying rollers 38. At the meeting point of the two paths 37 and 39, the sheet having the data (1) and the sheet having the data (2) are stacked in the order of the data (1) and (2) (in the order of the print data). The sheets thus stacked are conveyed by conveying rollers 40, so that they are placed in the stacker with the paddle 18.

In the case where the printing operation is performed repeatedly, the sheet arranging operation and the sheet stacking operation are carried out as follows:

In this connection, it is assumed that images of two pages of size "A4" sheets are formed on a size "A3" sheet (297 mm×420 mm), and the A3-size sheet is cut into two size "A4" sheets by the sheet cutting mechanism, and that the printing speed is 100 ppm (pages per minute) with A3-size sheets fed laterally, and the sheet feeding speed is 33 ips (inches per second).

Figure 4:
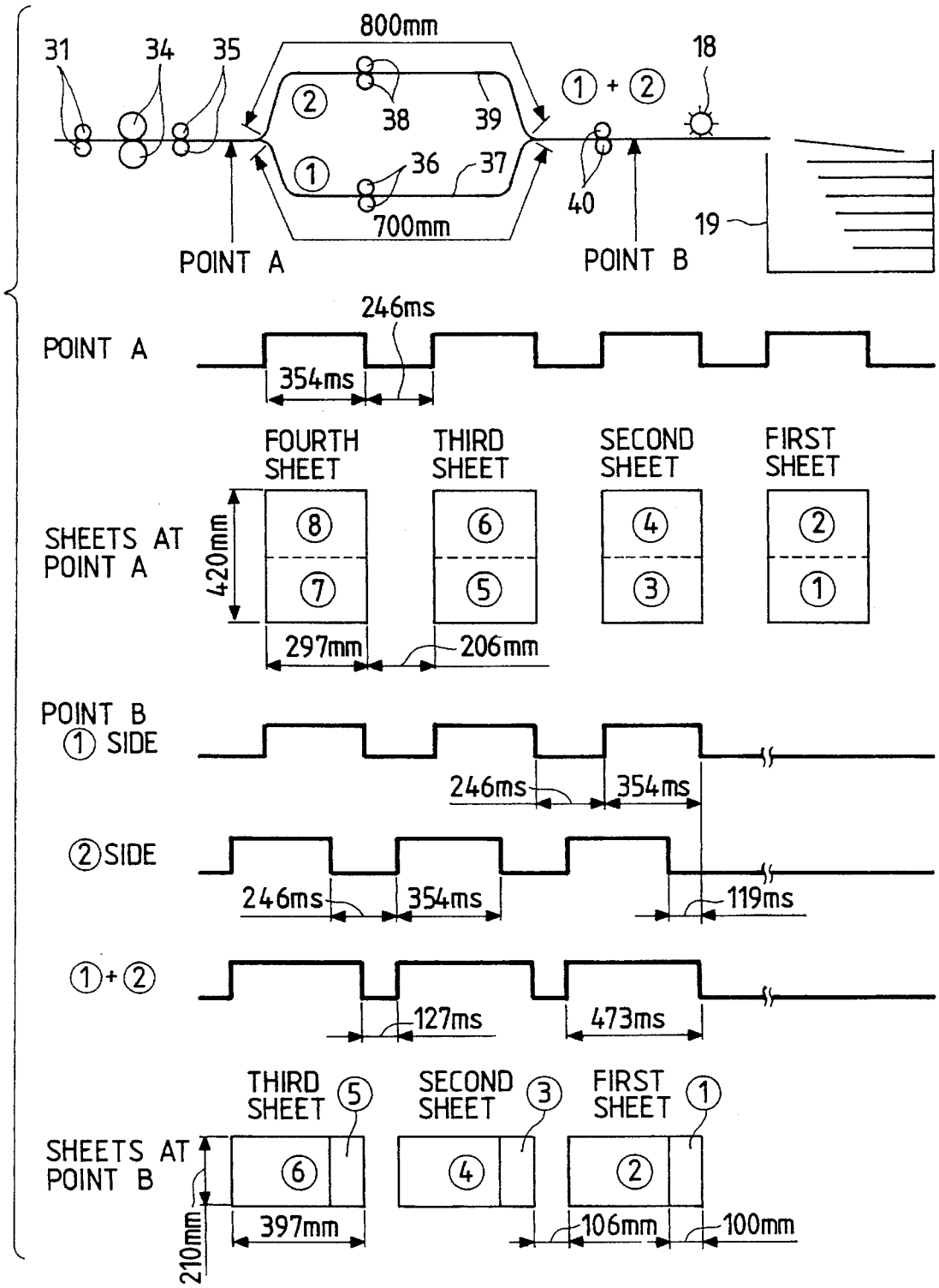
FIG. 4 is a time chart for a description of a sheet arranging operation and a sheet stacking operation performed by the apparatus of the invention.

At the point A in FIG. 4, the sheets arrive at time intervals of 246 ms with an inter-sheet distance of 206 mm. Hence, if the sheet arranging operation and the sheet stacking operation are not achieved within the time interval of 246 ms for any one of the sheets, then the sheet is pushed by the following sheet. In order to overcome this difficulty, the length of the conveying path 37 is set to 700 mm, and the length of the deflecting conveying path 39 is set to 800 mm. Hence, at the point B in FIG. 4 the arrival of the sheet having the data (2) conveyed along the deflecting conveying path 39 is delayed 119 ms corresponding to 100 mm. Hence, at the point B, the two sheets are stacked in the order of the print data being shifted by 100 mm from each other. At the point B, the sheets are conveyed at time intervals of 127 ms with an inter-sheet distance of 106 mm. Thus, the sheet arranging operation and the sheet stacking operation are smoothly carried out.

An object of slightly delaying the arrival of the sheet which is conveyed to the stacker 19 later is to improve the arrangement of the sheets in the stacker 19. The amount of delay is set to a suitable value according to the sheet conveying speed and the speed of rotation of the paddle 18. In the embodiment, the lengths of the conveying path 37 and the deflecting conveying path 39 are adjusted; however, the invention is not limited thereto or thereby. That is, the same effect can be obtained by adjusting the speeds of rotation of the conveying rollers 36 and the deflecting/conveying rollers 38.

As was described above, the image forming apparatus having the means for forming images of plurality of pages on one cut sheet, comprises: the sheet cutting mechanism for cutting a cut sheet on which images of plurality of pages have been formed into smaller sheets the number of which corresponds to the number of the pages; the sheet arranging mechanism for arranging the smaller sheets thus provided; and the sheet stacking mechanism for stacking the smaller sheets thus arranged. Hence, the image forming apparatus of the invention has the sheet post-processing function which is effectively performed in association with image forming means to achieve delicate control operations of the apparatus.

While there has been described in connection with the preferred embodiment of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An image forming apparatus having means for forming images of a plurality of pages on one cut sheet, said apparatus comprising:

sensing means for detecting an amount of shift of said cut sheet in a width direction of said cut sheet and outputting an amount of shift signal;

sheet cutting means for cutting, in response to said amount of shift signal, said cut sheet on which images of a plurality of pages have been formed into smaller sheets, the number of which corresponds to the number of said pages;

sheet arranging means for arranging said smaller sheets in a predetermined order; and sheet stacking means for stacking said smaller sheets from said sheet arranging means.

2. An image forming apparatus as claimed in claim 1, in which said sheet cutting means has a circular cutter comprising an upper blade and a lower blade.

3. An image forming apparatus as claimed in claim 2, in which said circular cutter is movable in the direction of width of said cut sheet.

4. An image forming apparatus as claimed in claim 2, further comprising:

position determining means for determining a sheet cutting position before said cut sheet is cut into smaller sheets;

wherein the movement of said circular cutter is controlled according to said amount of shift signal and an output of said position determining means.

5. An image forming apparatus as claimed in claim 4, in which said circular cutter is positioned at the middle of said cut sheet as viewed in the direction of width thereof.

6. An image forming apparatus as claimed in claim 1, in which said sheet arranging means comprises:

means for deflecting one of said smaller sheets towards the other to stack said smaller sheets in the order of print data; and means for conveying said smaller sheets stacked by said deflecting means.

7. An image forming apparatus having means for forming images of a plurality of pages on one cut sheet, said apparatus comprising:

sheet cutting means for cutting a cut sheet on which images of a plurality of pages have been formed into smaller sheets, the number of which corresponds to the number of said pages;

sheet arranging means for arranging said smaller sheets in a predetermined order;

sheet stacking means for stacking said smaller sheets from said sheet arranging means; and in which said sheet arranging means has at least two conveying paths different in conveyance distance and in conveyance time.

8. A method of arranging a sheet for an image forming apparatus, comprising the steps of:

forming images of a plurality of pages on a cut sheet;

sensing an amount of shift of said cut sheet in a width direction of said cut sheet and outputting an amount of shift signal;

cutting said cut sheet, in response to said amount of shift signal, into smaller sheets, the number of which corresponds to the number of said pages;

arranging said smaller sheets cut in said cutting step in order; and stacking said smaller sheets arranged in said arranging step.

9. A sheet arranging method as claimed in claim 8, in which said sheet arranging step and said sheet stacking step are achieved within a time interval provided between the successive arrivals of said sheets.

* * * * *